US009580974B2

(12) United States Patent
Carlsen et al.

(10) Patent No.: US 9,580,974 B2
(45) Date of Patent: Feb. 28, 2017

(54) SAFETY JOINT

(71) Applicant: FMC Kongsberg Subsea AS, Kongsberg (NO)

(72) Inventors: Hans-Paul Carlsen, Notodden (NO); Tor-Øystein Carlsen, Kongsberg (NO); Olav Inderberg, Kongsberg (NO); Anthony D. Muff, Kongsberg (NO); Arild Sundkvist, Kongsberg (NO); Pål Fadum, Kongsberg (NO); Roy Arne Klevstad, Kongsberg (NO); Thor-Arne Løvland, Oslo (NO); Simen Rønne, Kongsberg (NO); Geir Tandberg, Tranby (NO); Bernt Olav Tømmermo, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 14/759,866

(22) PCT Filed: Jan. 7, 2014

(86) PCT No.: PCT/EP2014/050145

§ 371 (c)(1),
(2) Date: Jul. 8, 2015

(87) PCT Pub. No.: WO2014/108398

PCT Pub. Date: Jul. 17, 2014

(65) Prior Publication Data

US 2016/0123092 A1 May 5, 2016

(30) Foreign Application Priority Data

Jan. 8, 2013 (NO) ..... 20130036

(51) Int. Cl.
*E21B 17/06* (2006.01)
*E21B 19/00* (2006.01)
(Continued)

(52) U.S. Cl.
CPC ..... *E21B 17/06* (2013.01); *E21B 17/01* (2013.01); *E21B 19/002* (2013.01);
(Continued)

(58) Field of Classification Search
CPC ..... E21B 17/01; E21B 17/06; E21B 19/002; E21B 19/004; E21B 19/16; Y10T 137/1774
See application file for complete search history.

(56) References Cited

U.S. PATENT DOCUMENTS 4,059,288 A 11/1977 Mohr
4,361,165 A * 11/1982 Flory ..... F16K 17/40 137/614.02

(Continued)

FOREIGN PATENT DOCUMENTS

GB 2483788 A 3/2012
WO WO 2009/153567 A1 12/2009

*Primary Examiner* — Matthew R Buck
*Assistant Examiner* — Aaron Lembo

(57) ABSTRACT

The invention relates to a safety joint and a method of operation, the safety joint comprising: a first riser part and a second riser part overlapping in an axial direction and having end connections to be connectable as part of a riser, a release unit, locking the two riser parts together in a not activated mode, the release unit having other modes comprising a partly activated mode and fully activated mode, where the release unit comprises at least one axial extending tension rod connected between the two riser parts, which tension rod is configured to deform plastically before breaking, thereby activating the partly and fully activated modes.

13 Claims, 5 Drawing Sheets

(51) Int. Cl.
*E21B 17/01* (2006.01)
*E21B 19/16* (2006.01)

(52) U.S. Cl.
CPC ..... *E21B 19/004* (2013.01); *E21B 19/16* (2013.01); *Y10T 137/1774* (2015.04)

(56) References Cited

U.S. PATENT DOCUMENTS

| | | | | |
|---|---|---|---|---|
| 4,712,620 | A | 12/1987 | Lim et al. | |
| 6,425,443 | B1 * | 7/2002 | Hill | E21B 17/06 166/242.6 |
| 6,530,430 | B2 * | 3/2003 | Reynolds | E21B 19/006 166/346 |
| 8,181,704 | B2 | 5/2012 | Fenton | |
| 8,727,014 | B2 * | 5/2014 | Edwards | E21B 19/006 166/350 |
| 9,353,602 | B2 * | 5/2016 | Kongshem | E21B 17/01 |
| 2010/0147530 | A1 * | 6/2010 | Adamek | E21B 17/07 166/367 |
| 2011/0067880 | A1 * | 3/2011 | Adamek | E21B 17/01 166/345 |
| 2011/0127041 | A1 * | 6/2011 | Edwards | E21B 17/085 166/365 |
| 2012/0031622 | A1 * | 2/2012 | Carlsen | E21B 19/006 166/355 |
| 2014/0186125 | A1 * | 7/2014 | Andresen | E21B 19/00 405/224.4 |
| 2014/0305655 | A1 * | 10/2014 | Otten | E21B 19/002 166/350 |
| 2015/0354296 | A1 * | 12/2015 | Tommermo | E21B 19/006 166/355 |

* cited by examiner

SAFETY JOINT

FIELD OF THE INVENTION

The invention relates to a safety joint, and an associated method of operation, to be used as part of a riser configuration offshore. More particularly, the invention relates to a pressure balanced safety joint comprising a release unit.

BACKGROUND OF THE INVENTION

Risers are normally used to link hydrocarbon wells on the seabed to offshore floating structures. A riser is normally made up of lengths of tubing of steel having significant diameter, making them heavy. The floating structure therefore needs to apply tension to the riser to prevent it from buckling and possibly to collapse under its own weight, and prevent the weight from acting on the wellhead. This tension system is also compensated for movements of the platform relative the seabed, e.g. to keep a relative steady tension in the riser. Problems may occur when the platform experiences conditions out of normal operation range such as drive-off and drift-off, or if the heave compensation system is not working properly. All these conditions may result in excessive tension in the riser, and at some point the riser will break. To address this problem, risers may be provided with a weak link which has a lower tensile rating than the other components of the riser such that one gets a breakage at a given/predetermined point in the riser when there is a given tension in the riser, known prior to the incident.

A weak link shall comply with the following requirements:

Protect barriers, both primary and secondary
Protect personnel
Protect environment A conventional weak link comprises two parts which are releasable attached to one another by, for example, studs, which fracture at a predetermined tensile force. Such conventional weak link systems shall be able to withstand tensile forces applied to the weak link not only by the offshore structure, but also by well pressure. The studs therefore have to be rated to separate at a tension which is a combination of the separation force supplied by the well pressure and the tension applied from surface. The well pressure fluctuates. At high well pressures a conventional weak link can provide a very limited operational utilization as it will require a very limited external tension before it breaks, and at low pressures a conventional weak link can fail to protect the system as it will require a relatively higher external tension before it breaks. This might be a problem, both with regards to the operational window, but also in relation to safe protection of existing equipment at the wellhead, such as the barrier within the well.

Another element with standard weak links is that breaking a weak link in a riser due to excessive tension, e.g. as a result of drive-off, drift-off or sudden raise in the fluid pressure within the riser, will release massive forces which will act on the riser giving the riser an undesired behaviour. If the riser breaks, due to excessive tension, the riser will act like a pulled-out spring and may, in a worst case scenario, shoot out of the water like a projectile towards the offshore structure and cause severe damage to personnel and/or the structure/platform. Another problem may be that if the weak link and/or riser connection break, entrapped gas or hydrocarbons may be released to the sea or surface. In such situations it is desirable to be able to control the behaviour of the riser and the riser content, and, possibly perform a controlled disconnect. Different solutions have been used in the technical fields of weak links and pressure compensated riser connections, including EP 2310613, U.S. Pat. No. 8,181,704, U.S. Pat. No. 5,382,052, U.S. Pat. No. 4,361,165 and U.S. Pat. No. 4,059,288.

An objective of the present invention is therefore to provide a safety joint that limits the problems related to prior weak links and allow for a larger operational envelope compared to traditional weak links.

SUMMARY OF THE INVENTION

The invention relates to a safety joint, and more particularly to a safety joint that gives the possibility of keeping a riser intact for a longer time period, and possibly keep some tension in the riser if the heave compensation system is locked up, such that an operator has time to perform a safer standard release of the riser from the wellhead.

Compared to a traditional weak link design, the safety joint according to the invention fulfils the following objectives:

Extends available time to perform ESD (Emergency Shut Down)/EQD
Provide tension in riser after activation of safety joint
Limits recoil due to hydrocarbon release
Independent of riser content
No cutting/closing of bore
Independent of internal pressure
Environmental friendly The safety joint according to the invention comprises a first and a second riser part, forming inner and outer riser parts respectively, which parts, respectively, are connected to an upper and lower part of the riser when in use in a riser.

These first and second riser parts are initially locked to each other with a release unit providing release functionality for the two parts which will be described below. This release unit will in a locked state act to move the two riser parts as one unit.

The invention is set forth and characterized in the independent claims, while the dependent claims describe other characteristics of the invention.

The invention relates to a safety joint comprising:

a first riser part and a second riser part overlapping in an axial direction and having end connections to be connectable as part of a riser,
a release unit, locking the two riser parts together in a not activated mode, the release unit having other modes comprising a partly activated mode and fully activated mode,
where the release unit comprises at least one axial extending tension rod connected between the two riser parts, which tension rod is configured to deform plastically before breaking, thereby activating the partly and fully activated modes.

According to an aspect the safety joint includes at least a cylinder arrangement, wherein the cylinder arrangement is arranged such that it compensates the at least one tension rod for internal pressure in the riser in the not activated mode and the partly activated mode, and the safety joint in the fully activated mode.

The cylinder arrangement may also be adapted for increasing the forces acting against release of the first and second riser parts in the fully activated mode.

The safety joint according to the invention will normally be positioned in the lower half of the riser, in proximity of the wellhead. In such a position in the riser the safety joint will experience the larger forces from the surrounding water. The riser may be any kind of riser.

The safety joint will during normal operations not be activated, i.e. it will be in the not activated mode, but in cases of excessive tension in the riser, the safety joint will be activated by the excessive tension. Excessive tension will actuate the release unit in two intermediate steps until a potential complete disconnection; a partly activated mode, a fully activated mode (whereupon there will be a telescopic action in the joint), and potentially ending in the complete disconnection where the two riser parts are completely separated. Both the initial and the intermediate steps of the release unit will be pressure compensated for pressure in the fluid within the riser. These steps will give time to operate a safe disconnection of the riser from the wellhead. If not, the safety joint may also be configured to release the two riser parts from each other, as a complete disconnect.

According to an aspect the cylinder arrangement may comprise one cylinder set arranged such that it compensates the at least one tension rod for internal pressure in the riser in the not activated mode and the partly activated mode, and that the one cylinder set is adapted for increasing the forces acting against the release of the first and second riser parts in the fully activated mode. In another embodiment the cylinder arrangement may comprise several sets of cylinders, providing the different functionalities to the release unit, as pressure compensation for internal pressure at different modes, and providing forces acting against release.

One possible solution is that the cylinder arrangement may comprise a first set of cylinders and a second set of cylinders, where the first set of cylinders is adapted for compensating the at least one tension rod for the internal pressure in the riser in the not activated mode. The second set of cylinders is adapted for compensating the at least one tension rod for the internal pressure in the riser in the partly activated mode, and wherein the second set of cylinders is adapted for increasing the forces acting against the release of the first and second riser parts in the fully activated mode.

According to the invention the tension rods will have an axial length, and be formed with a material enabling plastic deformation. This will allow them to deform a considerable length before breakage. The plastic deformation would possibly be around 10% of the axial original length of the tension rods. The plastic deformation of these tension rods will give a movement of the two riser parts and a relative movement of the elements in the cylinder arrangement connected to the different riser parts. This movement will initiate different steps in the activation of the release unit.

According to an aspect, the tension rod(s) will be connected to the two different riser parts of the safety joint, as will at least a cylinder with piston and piston rod as part of the cylinder arrangement. The safety joint may be configured such that pressure of the fluid within the riser would be acting on one side of the piston in the cylinder(s), in the opposite direction of both the tension force in the riser and an end cap effect of the internal pressure of the fluid in the riser acting in the same direction as the tension force. This will pressure compensate the tension rod for the pressure of the fluid within the riser. The areas of the piston(s) in the cylinders are balanced in relation to the end cap effect of the riser to achieve the desired effect, i.e. the sum up the areas of the pistons equals the area of the end cap, resulting in that the internal pressure of the fluid within the riser is cancelled out. This system may be used in connection with a cylinder arrangement with one set of cylinders, and an arrangement with first and second cylinder sets.

According to an aspect of the invention, with a release unit with the first and second cylinders, the first cylinder is arranged to pressure compensate the tension rods in a not-activated mode.

In the partly activated mode of the release unit, the tension rods will be extended as the tension in the material reaches the elasticity module of the material in the tension rods, thereby extending them in the axial direction permanently. This extension of the tension rods may result in that the pistons in the first set of cylinders move out of sealing contact with the respective cylinders, thereby enabling the possibility of providing a leakage of the operating fluid (hydraulic fluid) on the side of the pistons. The piston(s) in the first set of cylinders will thereafter not act as pressure compensators for the tension rods, and this has to be moved to the second set of cylinders as will be described below.

To achieve this desired leakage in the first cylinder set, one possible solution of this is to form the cylinder with different inner diameters in the length of the cylinder. Another possibility is to form a bore in the cylinder which is sealed by the piston in a first position but open when the piston is in another position. It is also a possibility to have leakage across the piston.

As the first set of cylinders no longer pressure compensate the tension rods, one do not want them to influence the safety joint unnecessary and one may therefore, when the safety joint extends further, release cylinder heads of the cylinders in the first set of cylinders, such as to minimize the risk of double compensation and influence of the first cylinder set. This release of the cylinder heads may be done in several manners, as breaking the cylinder head if it is of glass. Another possibility is to have the piston interact with the cylinder head and release the locking of the cylinder head in the cylinder. By releasing the cylinder heads, the first set of cylinders is exposed to the surrounding seawater. That is, if the fluid above the pistons in the cylinders in the first set of cylinders is bled off before the cylinder head is released, there are no pressure in the fluid acting on the cylinder head, thereby enabling a more controlled release of the cylinder head. It is important not to have a double pressure compensation of the tension rods as this may result in loss of control of the riser because the double compensation may over-compensate or under-compensate the riser.

In the partly activated mode of the release unit, the tension rods are according to the invention still pressure compensated. In the embodiment as referred to above, the second set of cylinders is adapted for compensating for the internal pressure in the riser in the partly and fully activated mode, which will be explained in more detail below.

Before a first step of the actuation of the release unit, also referred to as the not activated mode, the piston arranged in the second set of cylinders may be free floating in relation to the piston rod. The pistons will possibly be arranged near one end of the cylinders. The second cylinders will in this state not experience any of the pressure within the riser and they will neither influence the tension rods. The second set of cylinders will therefore not influence the safety joint until the safety joint is in the partly activated mode.

When the first step, the partly activated mode, of the release unit is activated, the tension rods are extended axially, this will move the piston rod relative the pistons in the second set of set of cylinders. This axial movement will lead to an interaction between piston rod and piston and they will be linked to each other. In addition, the first part of the riser will move relative the second part of the riser, and thereby open an access such that the pressure within the riser is acting on the piston in the second set of cylinders. The safety joint is then configured such that the pressure on the pistons in the second set of cylinders will act on the safety joint and thereby the tension rods and pressure compensates it in relation to the internal pressure in the riser. The opening transferring the pressure of the riser fluid to the second set of cylinders may be a fully open opening, or alternatively, there may be arranged restrictions in this opening, such as pressure operated valves, or other elements. The configuration of the safety joint may also be such that one may substitute these elements in the opening during maintenance of the safety joint, giving the safety joint modular properties.

One possible solution for providing this open access between the internal pressure of the riser and the second cylinder is to provide a sealing between the inner and outer riser parts. The sealing will be active when the first and second riser parts are in a fully collapsed state. When the first and second riser parts axially move, as the tension rods are extended, the seal will no longer be active and the internal pressure of the fluid inside the riser will move out into the annular space between the inner and outer part of the riser and out to the second set of cylinders, and will be acting on one side of the pistons in the cylinder, i.e. the side which provides a force in an opposite direction compared to the end cap effect of the riser. There may initially be provided a hydraulic fluid in this annular space. This solution also keeps the dirty fluid within the riser away from the cylinders and compensation system until the first step (the partly activated mode) is initiated and partly until the second step (fully activated mode) of the release unit is activated. Another possibility is to have a burst disk which ruptures with axial displacement of the two riser parts. There is also the possibility of providing the second set of cylinders with a system similar to what will be described in greater detail later, where the riser fluid will act on a membrane/bellow separating dirty and clean fluids and or the possibility to integrate a system allowing possible partial degradation In the fully activated mode of the release unit, the tension in the riser has exceeded another threshold value of the tension rod(s) such that the tension rods break. In this fully activated mode, when the tension rods are broken, the cylinder arrangement is configured to provide a force acting against the extension of the safety joint. The cylinder arrangement is also configured such that it allows a telescopic action between the two overlapping riser parts in the safety joint and pressure compensates the safety joint for internal pressure within the riser. The force created by the release unit will try to push the two parts telescoping towards each other, towards a collapsed state of the telescoping parts, thereby providing tension in the riser. This force will act against the separation forces. In one embodiment as referred to above with first and second cylinder sets, the second set of cylinders is in part generating this force.

As the riser parts move away from each other in the fully activated mode, the piston in the second set of cylinders will move away from a position close to an end position within the cylinder. As this space filled with a fluid at low pressure is a closed space, this movement will create a 'vacuum effect' in the fluid with the low pressure. This 'vacuum effect' will try to pull the piston back into the cylinder. In addition there will also be seawater pressing/pushing the piston rod into the cylinder. The sum of the seawater pressure on the piston rod end (the force resulting from a hydraulic column of seawater on the piston rod end) and the 'vacuum effect' in the cylinder will create a force pulling the upper and lower parts of the riser to a collapsed state, or with other words, act against the separation force.

An alternative to the fluid with low pressure is to equip the pistons in the second set of cylinders with tension elements pulling the piston(s) back into the cylinder. This may be done in addition to the arrangement creating the 'vacuum effect'. Another possibility is to use a magnetic field, electric motor or other techniques creating a force.

In another aspect the cylinder arrangement may also comprise a third set of cylinders. The third set of cylinders may be activated during the fully activated mode of the release unit. This third set of cylinders is provided with seawater on one side of the piston and a fluid at low pressure on the other side of the piston. When the safety joint is extending, the pressure from the seawater acting on one side of the piston and a "vacuum effect" on the other side of the piston will both assist in pushing or pulling the two riser parts to a collapsed state, respectively. I.e. the third cylinders provide a force that acts against the separation forces in the safety joint. This third set of cylinders is not in fluid connection with the internal fluid in the riser.

According to an aspect of the invention the third set of cylinders may also be used alone, i.e. without the use of neither the first nor second set of cylinders, or used in combination with the first and or second set of cylinders or used in combination with only the second set of cylinders, and without the rest of the release unit as such. One thereby has a riser joint, with a first and second riser part which is arranged overlapping and which allows telescopic movement between them, where a cylinder housing is connected to one riser part and a piston rod with piston connected to the other part. The space enclosed by the piston in sealing connection with the cylinder housing is filled with a fluid at relative low pressure, and the opposite side of the piston exposed to the pressure of the surroundings, i.e. seawater when in use. The joint may also be provided with a second set of cylinders and pistons, where one side of the piston is exposed to the fluid pressure within the riser and the opposite side of the piston experiences a fluid at relative low pressure. The space with low pressure creating a "vacuum effect" as the piston is moved out of the cylinder housing, pulling the piston back in the housing, the seawater pressure creating a force pressing the piston into the cylinder housing, both acting against separation forces in the joint, while the joint is pressure compensated for internal pressure within the riser.

According to the invention the piston rods, and thereby the pistons, are then connected with the first part of the riser and the cylinders are connected with the second part of the riser, alternatively they may be arranged opposite. They will then during normal use be forming an upper or lower part of the safety joint respectively, which may of course be changed without departing from the scope of the invention.

The first and second parts of the riser, and the cylinder and piston rod of the second set of cylinders and possibly the third set of cylinders, may have a length allowing telescopic motion between the riser parts without releasing the parts fully from each other. By allowing this movement, and also providing some tension in the riser due to the forces trying to pull the two riser parts together to a collapsed state, it is possible to initiate the release of the riser in a safe manner from the wellhead also in this fully activated mode without breaking off the riser as a standard weak link. By configuring the cylinder arrangement to provide a force acting against the separation forces in a fully activated mode, one creates some tension in the riser due to the telescopic motion. This will give the possibility to lift off the EDP (Emergency disconnect Package) from the LRP (Lower Riser Package) if the safety joint is positioned in an open sea mode, or possibly, disconnect subsea test tree latch in the landing string. During this controlled disconnection from EDP or LRP, the telescoping connection in the safety joint, between the first and second riser parts, will be forced to a collapsed state—minimizing the risk of an uncontrollable riser damaging the subsea equipment such as the EDP and LRP.

According to an aspect of the invention the first set of cylinders may have a smaller internal volume than the second set of cylinders. The difference in volume may possibly result in different stroke lengths in the first set of cylinders compared with the second set of cylinders. The first set of cylinders may in one embodiment have a shorter length than the second set of cylinders. The difference in volume may in addition to the difference in stroke length give a solution where the cylinder set with less volume gives a more responsive movement of the piston, i.e. more rapid response to the pressure variations in the riser. Even if an incompressible liquid is being used in the cylinders, the liquid will be somewhat compressible if the liquid volume is large. A smaller volume will therefore be favourable in the pressure compensation of the tension rods before they break or before they start to deform plastically, that is, in the partly and not activated mode of the release unit. However, it is desirable to have a large length of the piston rod in the cylinders in the fully activated mode, as the maximum telescopic motion of the safety joint will be limited by the stroke length of the piston in the cylinder.

According to another aspect of the invention the first set of cylinders may be connected to the second set of cylinders through a mechanical link, where the cylinders are arranged beside each other. The mechanical link may provide coordinated and linked movement of the pistons in the first and second set of cylinders in the not activated mode and possibly the partly activated mode. The first and second sets of cylinders may also be arranged as an extension of each other. The first and second sets of cylinders may be provided one on top of the other along the riser parts. They may be arranged as separate cylinders or they may form a common cylinder with two pistons, one of which is floating initially. The first and second sets of cylinders may have a common piston rod or separate piston rods. The first and second cylinders may also have common cylinder housing, or any combination of these arrangements.

According to the invention the different set of cylinders may comprise one cylinder or several cylinders. One set may comprise one cylinder and the other sets may comprise two, three, four, six, eight or more cylinders. The different sets of cylinders may also have equal or different numbers of cylinders. Alternatively the cylinder arrangement may be an annular cylinder arrangement or a combination of one or several annular cylinder/piston sets and none, one or several annular cylinder/piston sets. However, the cylinder arrangement should be balanced around the circumference of the safety joint.

The first, second and possibly third set of cylinders may be arranged around the circumference of the safety joint and on the radial outside of the first and second riser parts. They could be evenly spaced around the circumference and also evenly spaced in groups. The axially extending tension rods could be arranged in between the different cylinders. The tension rods may be positioned in between the first set of cylinders and have a length similar to the length of the first cylinder. Another possibly is to position the tension rods in between the second cylinders. The second and third sets of cylinders may be positioned in between each other around the same circumference with the first set of cylinders arranged axially above or below the second and/or third set of cylinders. The tension rods could be evenly spaced around the circumference or evenly spaced in groups around the circumference.

The riser parts will form part of the internal bore of the riser during use in a riser extending from the wellhead and up to a floating vessel. The second set of cylinders may have a stroke length similar to the length of the overlap between the first and second parts of the riser. The possibly third set of cylinders may have a similar length.

According to another aspect of the invention the safety joint may comprise a manifold adapted for distributing the internal pressure within the riser to the different cylinders in the cylinder arrangement, and the manifold may comprise at least one flow regulating means, which flow regulating means is adapted for regulating to which of the cylinders the fluid is distributed. The flow regulating means may also regulate the flow rate in one or both directions. There may be one manifold for the first set of cylinders. There may be one manifold for the second set of cylinders.

According to another aspect of the invention there may in relation to the manifold in a possible embodiment be a system that allows partial degradation without losing functionality of the overall safety joint system. The connection for transferring the internal pressure to the cylinders may be arranged such that is goes from one space, forming part of the manifold, possibly annular, feeling the riser pressure through a membrane, to at least two separate bores, each extending to different cylinders in the same set of cylinders. In the bore there may be arranged a floating piston between the one space and the cylinder(s). There may be one cylinder connected to each of these bores with a floating piston, or there may also be groups of cylinders connected to each of these bores with a floating piston, or a combination. This floating piston has at least one end position in the bore where it will seal off the bore between the space and the cylinder. There is also the possibility of having end positions for both ends of the floating piston. In a case with leakage in one of the cylinders, the floating piston for this cylinder will be pushed to its end position and thereby seal off this bore, while the rest of the cylinders will still be active and pressure compensate the tension rod. With an end position in the opposite direction of the floating piston, one may prevent the clean fluid within the bore to push the membrane into the riser bore. There may also be a pressure compensating system without the partial degradation functionality where the space leads to one bore with a floating piston, which bore after the floating piston forms a manifold leading to the several pistons. The floating piston will seal off the one bore when it comes to an end position in the bore, but thereby also seal off the pressure transfer between the riser and the cylinders. Both these possibilities may be considered a two barrier system or one may also provide the floating piston with a two barrier configuration, two pistons in series or two sealing surfaces on the one piston. Another possibility is to arrange the space to lead to several bores without the floating piston in the bore. However, this will only give a one barrier system.

The safety joint may also be provided with an override system to be used in situations where it is expected large external forces on the system, i.e. to provide a system that increases the connection force between the first and second riser parts and to make sure that the tension rods are kept undamaged. One such situation is for instance when the riser joint is lifted through the splash zone. This might be done by providing a separate cylinder/piston arrangement connected between the first and the second part of the riser, or alternatively by using all or some of the cylinders in the first set of cylinders for this function, or position these specific cylinders in between the cylinders in the first set of cylinders. The cylinder providing the override system is then fluid filled and locked in a set position. The fluid may be locked in the cylinders by means of a valve which may be remotely operated. The locked fluid within the cylinders may be released to an active receiver with for instance 1 bar pressure or to the sea. Alternatively, one may add an additional pressure to the fluid in the cylinder by a connection to a pressure cylinder with for instance ~700 bar pressure. This override system may comprise a set of cylinders, including one cylinder, but preferably two or more separate cylinders such as to provide redundancy in the system. In another embodiment the first set of cylinders may be provided with an opening allowing seawater pressure to act on the opposite side of the piston compared to the pressure from within the riser.

According to another aspect the invention has the functionality that one with a ROV (Remotely Operated Vehicle) may visually see if it has been formed a 'gap' in the safety joint, which indicates that the partly activated mode has been initiated and that the riser should be safely disconnected from the wellhead, taken topside for maintenance and installation of new tension rod(s). One thereby reset the safety joint back to its original state. One may also provide a monitoring of the gap, e.g. to give a signal to the operator if this first step (partly activated mode) of the release unit has been activated. This signal may be transferred to the operator remotely or in any other appropriate way.

In an aspect it is possible to arrange the second set of cylinders to compensate the tension rods for internal pressure during the whole operation, in the non-activated, partly activated and fully activated modes, making the first set of cylinders unnecessary. There may in this embodiment also be third cylinders, but it is possible to think of a solution without these.

According to other aspects of the invention the safety joint may in addition, be equipped with a glass element and a breaking system which will, if the safety joint is extended to a predetermined length, initiate the breaking of the glass element and thereby release the two riser parts at the safety joint. There may also be a glass element in the form of a burst disc, which burst disc is adapted to rupture at predetermined pressure differences. The burst disc allows for pressure communication between different cylinders in the cylinder arrangement, between the cylinder arrangement and the interior of the riser and/or between the cylinder arrangement and the seawater.

There is also provided a solution for keeping the system with clean fluid in the hydraulic system in the partly activated mode and only releasing clean fluid to the surroundings. The released clean fluid from this first set of cylinders will be a relatively small amount of clean fluid.

According to the invention there may be alternative solutions for activating the partly activated mode and fully activated mode. These solutions may be electrical controlled, systems with springs, deformation controlled systems, brake pads on rod etc.

The invention also relates to a method of operating a safety joint in case of excessive tension in a riser, providing a riser with a safety joint comprising a first riser part and a second riser part overlapping in an axial direction and connecting the ends to make the joint form part of a riser, the safety joint further comprising a release unit with at least one axial extending tension rod connected between the two riser parts, wherein in a not activated mode, the safety joint is keeping the riser parts as one unit and pressure compensates the tension rods for internal pressure within the riser, increasing the tension in the riser to a partly activated mode, thereby creating plastic deformation of the tension rods, further increasing the tension in the riser to a fully activated mode thereby breaking the tension rods, and in all modes, not activated, partly activated and fully activated, allowing controlled disconnection of the riser at another joint in the riser, or in a fully release mode, when tension is further increased, release the two riser parts of the safety joint.

The method may in one embodiment, after the step of increasing the tension in the riser to a fully activated mode thereby breaking the tension rods, further comprise a step of activating a set of cylinders in a cylinder arrangement and creating a force in the safety joint acting against the release of the two riser parts, and allowing telescopic action in the safety joint.

The fluid pressure of at least one cylinder of the cylinder arrangement may be used to control other elements of the riser, such as for instance the EQD connection or another riser joint in the riser such as the joint described in the applicants own U.S. Pat. No. 328,634. The pressure signal from the pressure within the cylinder arrangement of the present invention may be transferred as input signals in the joint described in U.S. Pat. No. 328,634. In the case where the safety joint is applied to a riser with no internal pressure, such as for instance a marine riser, the safety joint is applied to the riser without an arrangement for compensation for internal pressure.

BRIEF DESCRIPTION OF THE DRAWINGS

These and other characteristics of the invention will be clear from the following description of an embodiment, given as a non-restrictive example, with reference to the attached drawings wherein;

FIGS. 1 and 2 show an embodiment of a safety joint 4 according to the invention. The safety joint 4 is adapted to make part of a riser extending from a floating platform to a wellhead or similar.

Figure 1:
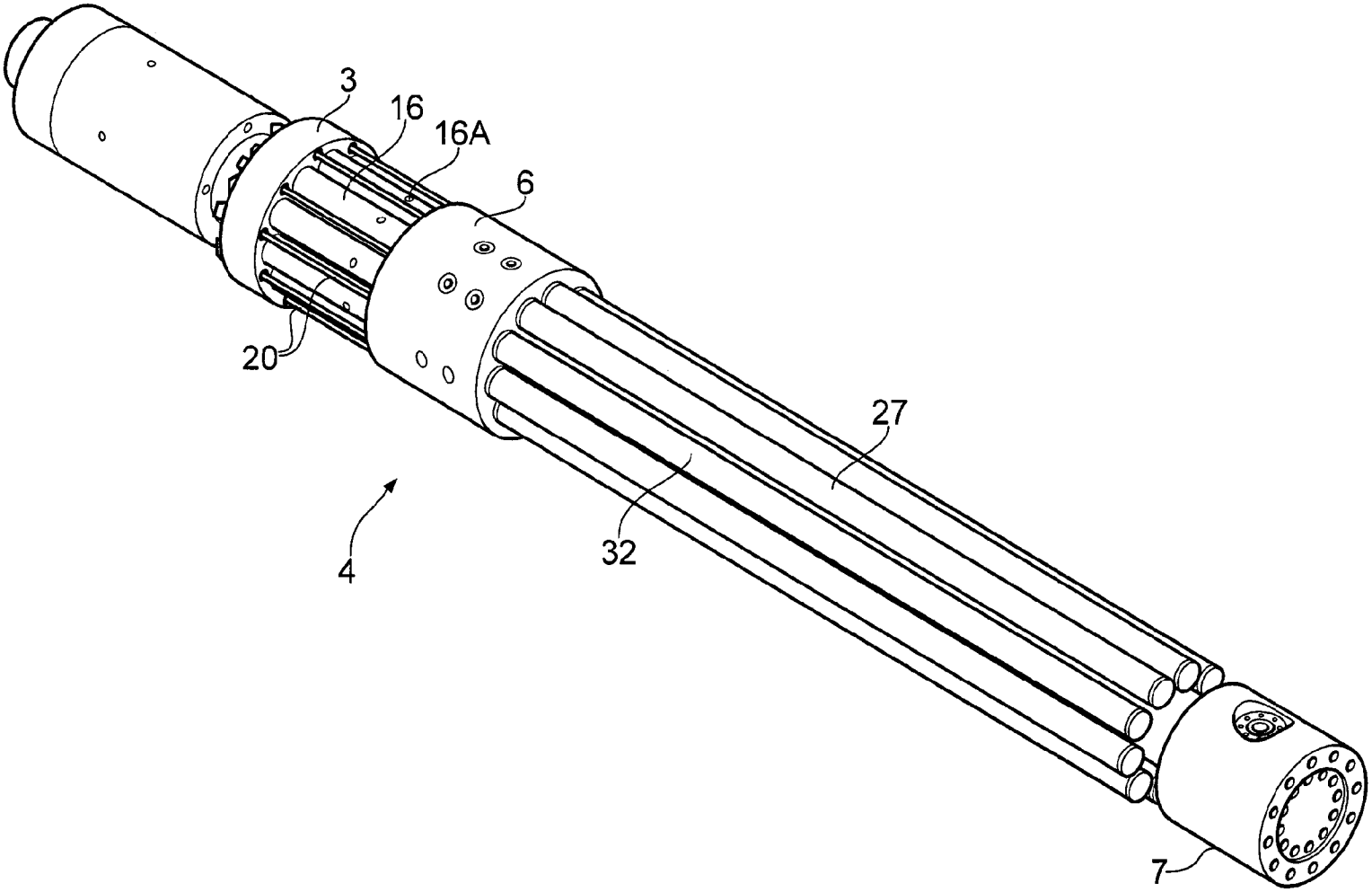
FIG. 1 discloses a side-view of a safety joint according to the invention.

The safety joint 4 comprises a release unit, locking two riser parts 8, 9 together in a not activated mode. The release unit also has a partly activated mode and fully activated mode, as will be explained in the following.

The release unit of the safety joint 4 comprises at least one axial extending tension rod 20 connected between the two riser parts 8, 9, which tension rod 20 is configured to deform plastically before breaking, thereby activating the partly and fully activated modes. The at least one tension rod 20, is axially arranged along the longitudinal direction of the safety joint 4. The tension rod(s) 20 is connected to a first connection piece 3 in the upper end and a manifold shown in the figures as a manifold block 6 in its lower end. In between the tension rods 20 there is arranged a first set of cylinders 16. The first set of cylinders 16 may comprise one or a plurality of cylinders. The first set of cylinders 16 may have perforations 16A to the sea. A second set of cylinders 27, which set may comprise one or a plurality of cylinders, is arranged below the first set of cylinders 16. The cylinders of the second set of cylinders 27 are connected to the manifold block 6, which manifold block 6, through an outer barrel 2, is connected to a second connection piece 7. The manifold block 6 and the connection piece 7 are arranged in a fixed distance, while an inner pipe 1 and the cylinder rod of the second set of cylinders 27 may telescope. The cylinder rods of the cylinders of the first set of cylinders 16 are connected to the cylinder rods of the cylinders of the second set of cylinders 27. In an alternative embodiment the positioning of the first set of cylinders 16 and the second set of cylinders 27 may be switched, whereby the connections between the different parts may be similar to the described embodiment. In between the second set of cylinders 27, there may be arranged a third set of cylinders 32, which third set of cylinders 32 may comprise one or a plurality of cylinders. In the shown embodiment the third set of cylinders 32 has equal length as the second set of cylinders 27. The different sets of cylinders 16, 27, 32 will be described in more detail below.

Figure 2:
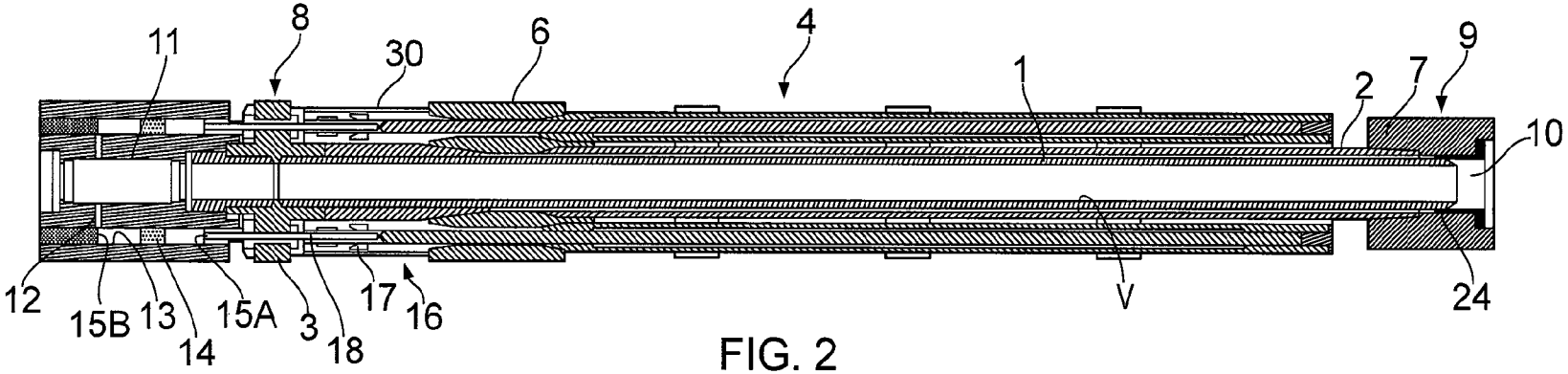
FIG. 2 discloses a cross section of a safety joint according to the invention in a collapsed state.

FIG. 2 shows a cross-sectional view of the safety joint 4 according to the invention, where the safety joint is in the not activated mode (collapsed state), which mode is the normal operation mode for the safety joint 4. An inner bore 10 is formed in the safety joint 4 and extends through the whole length of the safety joint 4 in the extension of the bore 10 of the riser, for a continuous passage between a well and a surface. The safety joint 4 comprises a first 8 and a second 9 riser part arranged in a telescopic connection. The first riser part 8, i.e. possibly the upper part of the safety joint 4, is arranged in an overlapping manner in relation to the second riser part 9. The first riser part 8 has an inner barrel 1 movably arranged inside the outer barrel 2 of the second riser part 9, forming a volume V between the inner 1 and outer 2 barrel. A sealing system 24 seals between the inner barrel 1 and the outer barrel 2 in the lowermost part of the inner barrel 1, in the not activated mode of FIG. 2. The inner barrel 1 is connected to the first riser part 8 via the first connecting piece 3. The outer barrel 2 is connected to the second riser part via the second connection piece 7. It is possible to arrange these elements in the opposite manner.

Figure 5:
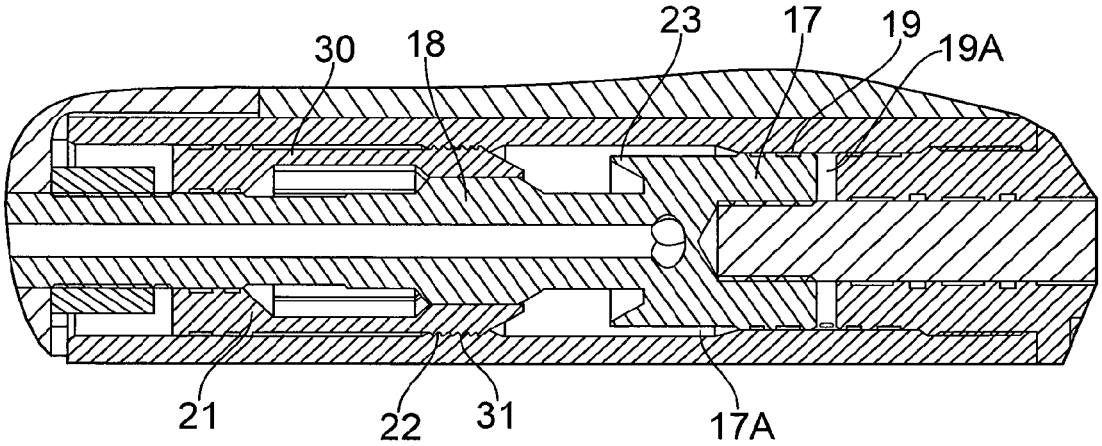
FIG. 5 discloses a detailed view of the connection between the first set of cylinders and the second set of cylinders according to the invention.

It is arranged one, or a plurality of, first radial bores 12 fluidly connecting the inner bore 10 with one, or a plurality of, axial bores 13 arranged on the radial outside of the inner bore 10. Furthermore, each axial bore 13 is connected to a cylinder of the first set of cylinders 16. A fluid-tight floating piston 14 floats inside each axial bore 13, which floating piston 14 can move between a first stopping surface 15A and a second stopping surface 15B in the axial bore 13. The floating piston 14 moves in the axial bore 13 as a response to pressure differences between the first and second side herein after referred to as upper and lower side of the floating piston 14. Which side is the upper and lower may be changed dependent of the configuration of the safety joint. The pressure from the inner bore 10 acts on the upper part of the floating piston 14, while the pressure of each cylinder in the first set of cylinders 16 acts on the lower part of the floating piston 14. In the not activated mode, the first set of cylinders 16 will pressure compensate the safety joint 4, as the total downwardly working area 17A (best shown in FIG. 5) of the piston(s) 17 in the first set of cylinders 16 is similar to the upwardly working end cap area in the bore 10 of riser in order to compensate the internal pressure in the inner bore 10, as the sum of the areas 17A of the pistons 17 equals the area of the end cap.

A number of axial tension rod(s) (not shown in FIG. 2, element 20 in FIG. 1) may be arranged in between the first set of cylinders 16. The tension rods 20 may deform axially plastically (up to ~10% its original length), before they break. These tension rods 20 would possibly have a length of 0.5 meter to 2 meter, possibly 1 meter, dependent on the material in the tension rods and the configuration of the safety joint 4. The extension of the tension rod will initiate the different modes of the safety joint. The operator can choose the strength of the tension rods as a result of the demands of different projects. During normal operating conditions, i.e. when the safety joint 4 is in the not activated mode, the tension rod(s) are intact and not exposed to any excessive forces and pressure compensated in relation to internal pressure within the riser.

On the inside of the inner bore 10, covering the first radial bores 12, it is arranged a bellow 11 allowing pressure communication between the inner bore 10 and the axial bores 13. The bellow 11 separates the riser fluid from a clean hydraulic fluid in the axial bore 13. Each of the axial bore(s) 13 is as said fluidly connected to one cylinder of the first set of cylinders 16, such that the clean hydraulic fluid in the axial bore(s) 13 is the same hydraulic fluid as in the first set of cylinders 16. Thus, a downward movement of the floating piston 14 in the axial bore (as a response to a pressure increase of the fluid inside the riser) will result in a pressure increase in the clean hydraulic fluid, which pressure in the fluid will act on the downwardly working area 17A of each cylinder/piston 17. Alternatively, one may have a solution without a bellow 11, where the floating piston 14 will act as the dividing unit between the riser fluid and the clean hydraulic fluid.

If the safety joint 4, i.e. the tension rods 20, experiences excessive tension forces, as a result of e.g. excessive tension in the riser, the tension rods 20 will start to deform plastically in the axial direction and that will give a relative movement between the first connecting piece 3 and the manifold block 6. This situation, i.e. the situation where the tension rods 20 has begun to plastically deform, is referred to as the partly activated mode. The plastically deformation of the tension rod(s) 20 will cause numerous actions in the safety joint 4, disclosed in FIG. 3.

Figure 3:
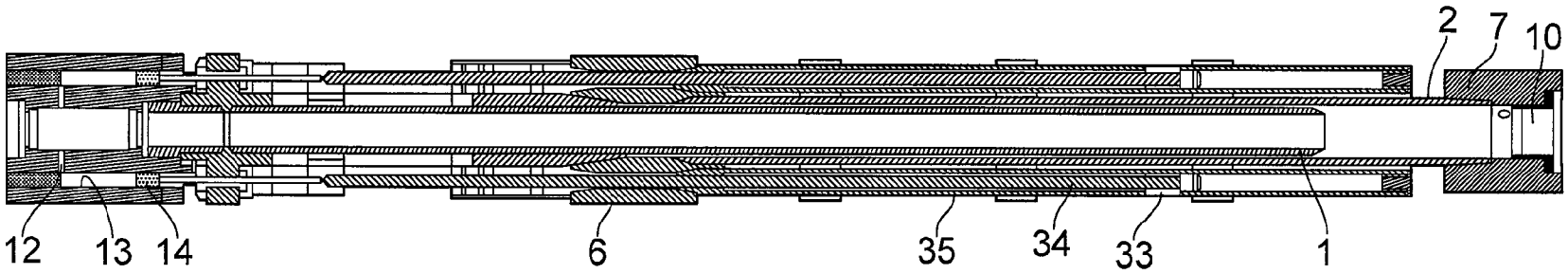
FIG. 3 discloses a partly activated mode of a safety joint according to the invention.

FIG. 3 discloses the partly activated mode of the safety joint 4, where the tension rod(s) 20 has started to deform due to excessive tension. In the disclosed partly activated mode, the compensation of the tension rods in relation to the internal pressure in the bore 10 of the riser is transferred from the first set of cylinders 16 to the second set of cylinders 27.

The deformation of the tension rods 20 will actuate a movement of the piston rod 18, including the piston 17, of the first set of cylinders 16. When the relative movement has reached a distance the piston 17 is moved out of a sealed abutment with a sealing surface 19 (see detailed view in FIG. 5) in a cylinder 30. One will then have a leakage across the piston 17, and this piston 17 will no longer compensate the tension rods 20 for internal pressure within the riser. This compensation is then transferred to the second set of cylinders 27. This movement also moves a thickened portion of the piston rod 18 out of locking contact with radial extending "fingers" 22 connected to the cylinder end cap/cylinder head 21. This locking contact locks the fingers 22 in contact with holding ridges 31 in the inner cylinder wall. When the piston 17 continues to move as the tension rods 20 are plastically deformed further, the radial extending "fingers" 22 of the cylinder end cap/cylinder head 21 interact with a release part 23 of the piston 17 and moves the fingers 22 out of engagement with complementary holding ridges 31 in the cylinder wall, allowing the piston rod 18, piston 17 and end cap of the cylinder to move upwardly in the cylinder. The piston(s) 17 of the first set of cylinders 16 are provided with the release part 23, which release part allows for flexing the fingers 22 inwardly when the piston 17 moves upwards in the cylinder. This releases the cylinders 30 in the first set of cylinders 16 into two separate parts and there are no forces from the first cylinder set 16 acting on the safety joint 4. As the piston 17 moves upwardly with the piston rod 18 in the initial extension of the tension rods 20, a smaller and smaller area of the sealing surface 19 seals between the piston 17 and the cylinder 30. And, when the piston 17 has moved out of sealing engagement with the cylinder through sealing surface 19, the hydraulic fluid on the upper part of the piston 17 (working on the working area 17A) will be allowed to flow on the radial outside of the piston 17 due to the increased diameter of the cylinder. Until the leakage across the piston 17, the floating piston 14 that is floating inside the axial bore 13 will move in an upward direction to the second stopping sealing surface 15B providing a limit of how much fluid that can be pushed up towards the bellow 11, and thereby preventing the bellow 11 to be pushed into the internal bore 10 of the riser. Additionally, it is also arranged bores 19A to the surroundings allowing seawater to enter through said bores 19A and act on the lower part of the floating piston 14 when the system is in the partly activated mode. At this time the first set of cylinders 16 is no longer pressure compensating the safety joint 4 and the pressure compensation is transferred to the second set of cylinders 27, which is described below.

Simultaneous with the movement of the piston rod 18 and piston 17, the inner barrel 1 will move axially upwards relative the outer barrel 2 because of the axial deformation of the tension rods 20, such that the sealing system 24 will no longer seal between the inner barrel 1 and the outer barrel 2, allowing the pressure in the riser to enter the volume V between the inner 1 and outer 2 barrels. The pressure/fluid will then transfer through the volume V towards the manifold block 6 (detailed view FIG. 4) and into a second radial bore 26, through the manifold block 6, and flow into one or more cylinders of the second set of cylinders 27, acting on an upper part of each piston 33 in each cylinder 35 in the second set of cylinders 27. Similarly as was the case of the first set of cylinders 16, the upwardly working forces of the riser fluids inside the bore 10, i.e. the "end cap" force, is balanced out by providing a downwardly working area that is the same or similar size as the end cap area of the riser bore 10. The second set of cylinders 27 will also work against the separation of the first and second riser parts 8, 9 by a "vacuum effect" in each cylinder 35, i.e. that there is vacuum or a fluid with 1 bar pressure on the lower side of each piston 33 in the cylinders 35. When the piston 33 is moved in the cylinder 35, this fluid will have a larger volume to fill, thereby creating an even lower pressure creating a force pulling the piston 33 towards the collapsed state, i.e. the collapsed state of the cylinder, into the cylinder again. Additionally, the hydrostatic pressure of the seawater will act on the top area of each piston rod 34 adding an additional force in the downward direction of the system. At this point the second set of cylinders 27 will provide the pressure compensation of the safety joint 4 in relation to internal pressure within the riser.

One or more of the cylinders in the second set of cylinders 27 may be replaced by a third set of cylinders 32. This third set of cylinders 32 is not connected to the inner bore 10 of the riser, but is open to the sea, resulting in that the hydrostatic pressure of the seawater at the given location is working on the upper side of the piston, and a "vacuum effect" is working on the lower side of the piston. At large water depths this third set of cylinders 32 may provide quite a substantial additional force working against separation of the first and second riser parts 8, 9 due to the large hydrostatic column of seawater.

Figure 4:
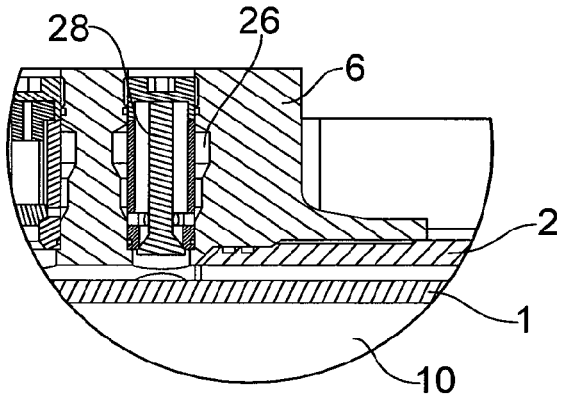
FIG. 4 discloses a detailed view of a manifold block in the safety joint according to the invention.

FIG. 4 shows an embodiment of the manifold block 6 mounted to the outer barrel 2. At least one second radial bore 26 extends in the radial direction of the manifold block 6 and create a connection between the internal fluid in the riser and the second set of cylinders 27. The second bore 26 may be fully open, or it may be arranged flow regulation means in the bore 26, such as a valve, burst disc, choke valve etc. In the shown embodiment, it is arranged flow regulating means exemplified as a valve 28 in the second bore 26. The second bore 26 is connected to the volume V between the inner barrel 1 and the outer barrel 2 on one side, leading to the volume(s) of the cylinders of the second set of cylinders 27 on the other side. The safety joint 4 may be provided with access to this bore 26 from the outside of the safety joint 4 making it possible to change out any element positioned in this bore 26 without disassembling the whole safety joint 4.

Figure 6:
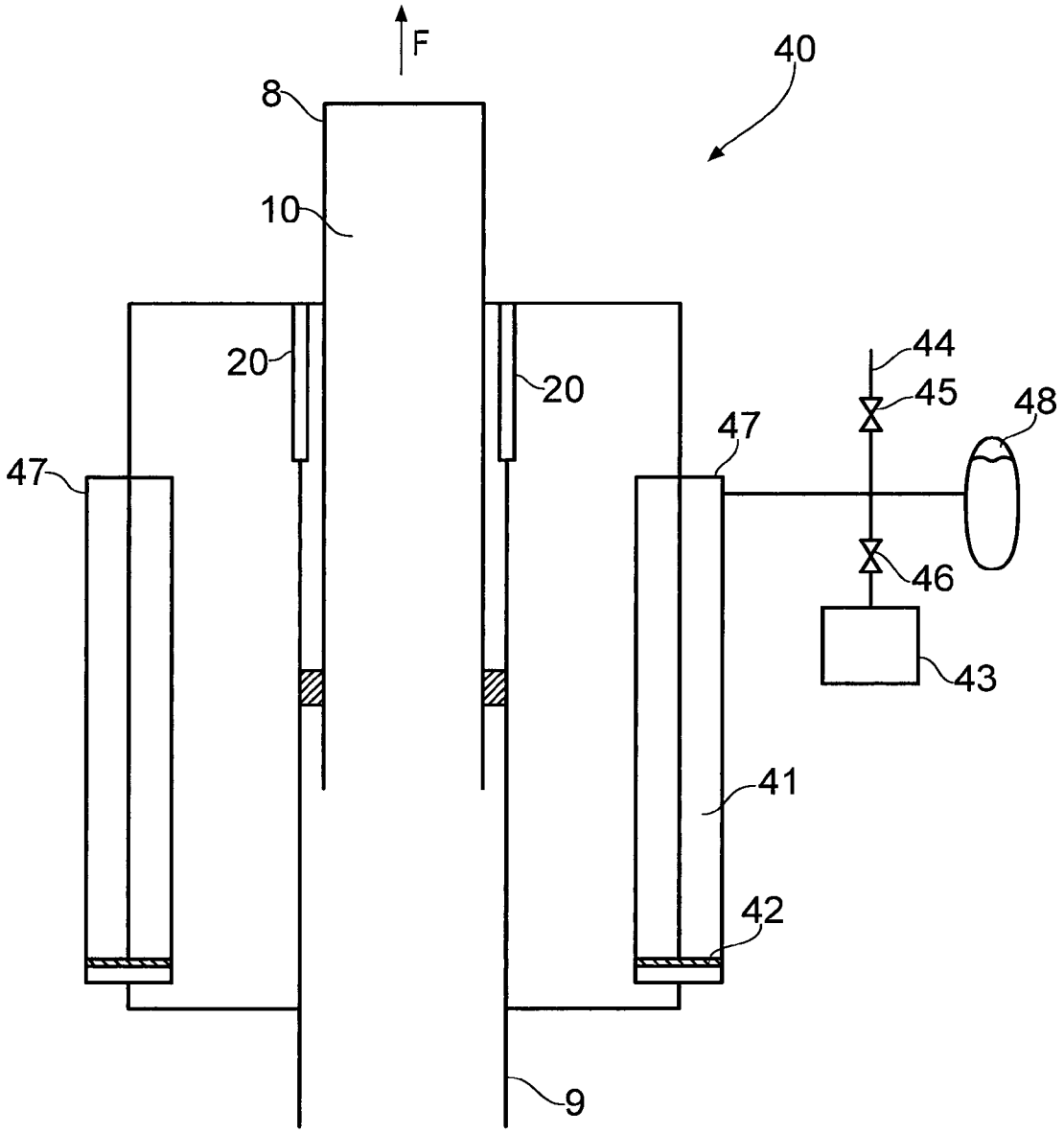
FIG. 6 shows a simplified perspective view of an override system according to the invention.

FIG. 6 shows a perspective view of an override system according to the invention. The override system may be used in situations where it is expected large external forces on the system, i.e. to provide a system that increases the connection force between the first and second riser parts 8, 9 and to make sure that the tension rods 20 are kept undamaged. This might be done by providing a separate cylinder/piston arrangement 40 connected between the first and the second part of the riser 8, 9, or alternatively by using the first set of cylinders 16, or a combination of the first set of cylinders 16 and the separate cylinder/piston arrangement 40 for this function. The volume 41 above the pistons 42 in the override cylinders 47 making up the separate cylinder/piston arrangement 40 is then fluid filled and locked in a set position. The fluid may be locked/trapped in the override cylinders 47 by means of a valve (not shown) which may be remotely operated. The locked/trapped fluid within the override cylinders 47 may be released to an active receiver 43 with for instance 1 bar pressure or to the sea 44. Valves 45, 46 may be provided between the sea 44 and the override cylinders 47 and between the active receiver 43 and the override cylinders 47. Alternatively, one may add an additional pressure to the fluid in the override cylinders 47 by a connection to a pressure cylinder 48 with for instance ~700 bar pressure. This override system may comprise a set of cylinders 47, including one cylinder, but preferably two or more separate cylinders such as to provide redundancy in the system.

Figure 7:
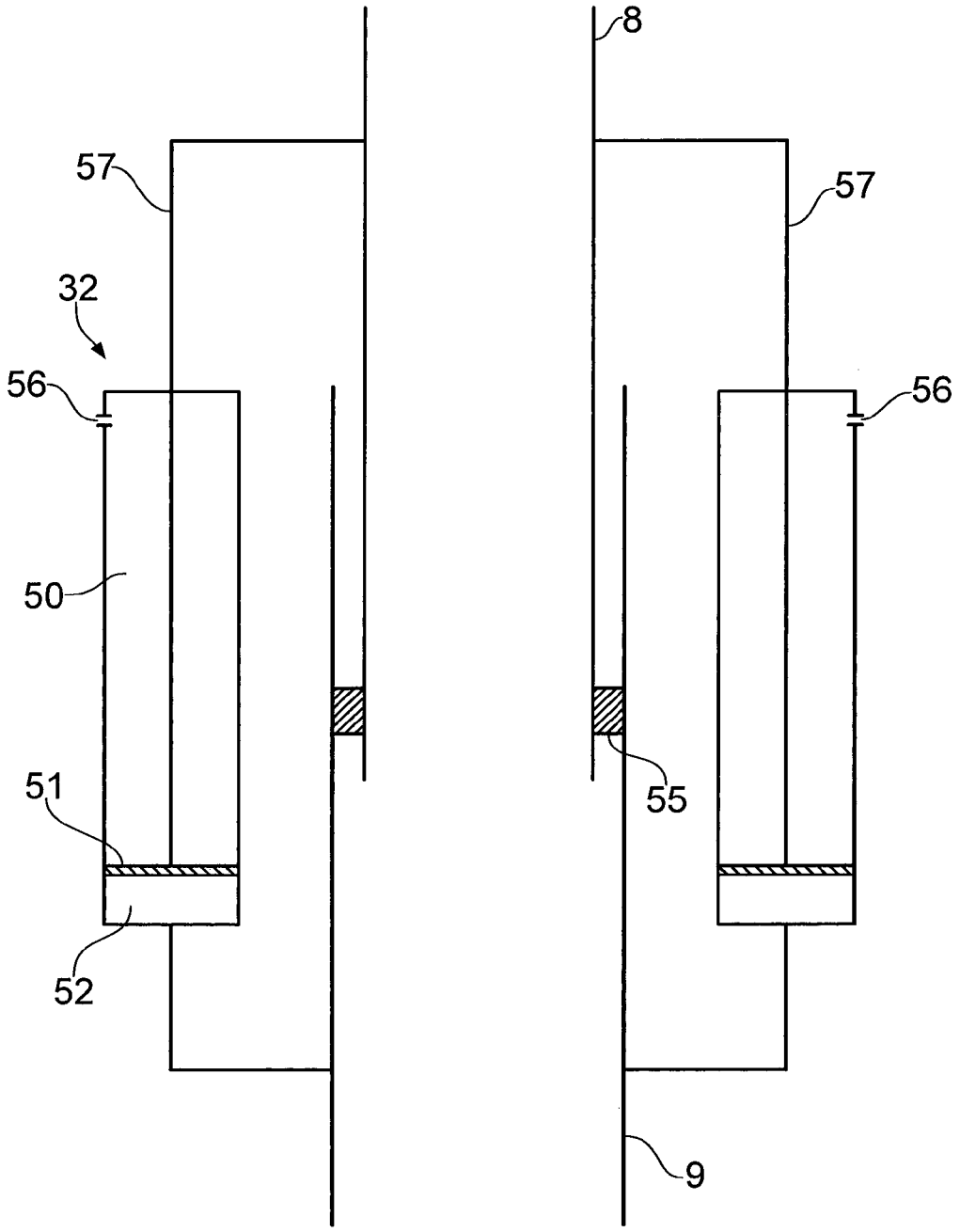
FIG. 7 shows a simplified perspective view of a third set of cylinders according to the invention.

FIG. 7 shows a simplified perspective view of a third set of cylinders according to the invention. In one embodiment one may also provide the safety joint 4 with an additional third set of cylinders 32, which third set of cylinders 32 may comprise one or a plurality of cylinders, and which are activated during the fully activated mode of the release unit. The cylinders of the third set of cylinders 32 is provided with at least one opening 56 to the sea in the volume 50 on the upper side of the cylinder piston 51, and has a fluid on the lower side 52 of the piston 51. The figure shows that the cylinder rod 57 is mechanically linked to the first riser part 8 and the cylinder is mechanically linked to the second riser part 9. This is the situation after the safety joint has telescoped a minor predetermined distance, whereby it should be understood that the cylinder rod 57, in appropriate ways, will be connected to the first riser part 8 after the minor telsecoped distance. When the safety joint 4 is extending, the pressure from the seawater acting on the upper side of the cylinder piston 51 and the "vacuum effect" (~low pressure) on the lower side of the piston 51 both assist in forcing the two riser parts 8, 9 to a collapsed state, i.e. it provides a force that acts against the separation forces in the safety joint 4.

According to an aspect of the invention it the may be provided a joint with a first and second overlapping riser parts allowing telescopic movement between the two different parts, to which two parts there may be connected a cylinder arrangement comprising at least one cylinder as described in relation to the third set of cylinders above. This will give a possibility of having heave compensating system with the seawater as the accumulator bank. In another possible configuration one may have such a joint with the addition of at least one cylinder as described in relation to the second cylinders above. One thereby gets a pressure compensated telescopic joint with the seawater as the accumulator bank in the system.

In an alternative embodiment of the safety joint one may use another element to be plastically deformed as the safety joint is extended in the partly activated state. It is possibly to provide a sleeve in the joint and have this plastically deformed, for instance widened to get a somewhat controlled extension of the safety joint before it reaches the fully activated state.

The invention is now explained with reference to the accompanied drawings. A skilled person will understand that there may be made alterations and modifications to this embodiment that are within the scope of the invention as defined in the attached claims.

The invention claimed is:

1. A safety joint comprising:

a first riser part and a second riser part which overlap in an axial direction, each riser part having a respective end connection which is connectable to a corresponding section of a riser;

a release unit which includes at least one axially extending tension rod connected between the first and second riser parts;

wherein the release unit is configured such that, in a not activated mode of the release unit the at least one tension rod locks the first and second riser parts together, in a partly activated mode of the release unit the at least one tension rod plastically deforms and thereby allows the first and second riser parts to move apart an initial distance, and in a fully activated mode of the release unit the at least one tension rod breaks and thereby allows the first and second riser parts to move apart an additional distance before the first and second riser parts separate from each other.

2. The safety joint according to claim 1, further comprising at least one cylinder arrangement which is connected between the first and second riser parts and is configured to compensate the safety joint and the at least one tension rod for internal pressure in the riser in the not activated mode and the partly activated mode and to compensate the safety joint for internal pressure in the riser in the fully activated mode.

3. The safety joint according to claim 2, wherein the cylinder arrangement is adapted to increase the forces acting against release of the first and second riser parts in the fully activated mode.

4. The safety joint according to claim 2, wherein the cylinder arrangement comprises one cylinder set which is configured to compensate the at least one tension rod for internal pressure in the riser in the not activated mode and the partly activated mode and to increase the forces acting against the release of the first and second riser parts in the fully activated mode.

5. The safety joint according to claim 2, wherein the cylinder arrangement comprises a first set of cylinders and a second set of cylinders, and wherein the first set of cylinders is adapted to compensate the at least one tension rod for the internal pressure in the riser in the not activated mode, the second set of cylinders is adapted to compensate the at least one tension rod for the internal pressure in the riser in the partly activated mode, and the second set of cylinders is adapted to increase the forces acting against the release of the first and second riser parts in the fully activated mode.

6. The safety joint according to claim 5, wherein the first set of cylinders is shorter in length than the second set of cylinders.

7. The safety joint according to claim 5, wherein the first set of cylinders is connected to the second set of cylinders through a mechanical link, and wherein pistons in the first and second sets of cylinders move equally in the not activated mode and the fully activated mode.

8. The safety joint according to claim 5, wherein the cylinder arrangement comprises a third set of cylinders which is adapted to be activated during the fully activated mode of the release unit.

9. The safety joint according to claim 8, wherein the third set of cylinders comprises a piston and is in communication with seawater on one side of the piston and with a fluid on the other side of the piston, and wherein the third set of cylinders is adapted to contribute to the force acting against release of the first and second riser parts in the fully activated mode.

10. The safety joint according to claim 5, further comprising a manifold which is adapted to distribute a fluid to the different cylinders in the cylinder arrangement in order to compensate for the internal pressure within the riser, the manifold comprising at least one flow regulating means which is adapted to regulate to which of the cylinders the fluid is distributed.

11. The safety joint according to claim 10, wherein the manifold comprises at least one bore which leads to a cylinder comprising a floating piston.

12. A method of operating a safety joint in a riser, the safety joint comprising first and second riser parts which overlap in an axial direction and a release unit which includes at least one axially extending tension rod connected between the first and second riser parts, the method comprising:

connecting the first and second riser parts to corresponding lengths of the riser to make the safety joint form part of the riser;

in a not activated mode of the release unit, keeping the riser parts connected together and pressure compensating the tension rods for internal pressure within the riser;

increasing the tension in the riser to activate a partly activated mode of the release unit, thereby causing plastic deformation of the tension rods and allowing the first and second riser parts to move relative to each other over a small distance;

further increasing the tension in the riser to activate a fully activated mode of the release unit, thereby breaking the tension rods; and allowing controlled disconnection of the riser at another joint in the riser in each of the not activated, partly activated and fully activated modes; or in the fully activated mode, further increasing the tension in the riser to thereby separate the first and second riser parts from each other.

13. The method according to claim 12, further comprising:

after the step of increasing the tension in the riser to a fully activated mode and thereby breaking the tension rods, activating a set of cylinders in a cylinder arrangement to create a force in the safety joint acting against the release of the two riser parts, said cylinders being connected between the first and second riser parts; and allowing further telescopic action in the safety joint.

* * * * *